United States Patent [19]

Haynes et al.

[11] Patent Number: 4,827,808

[45] Date of Patent: May 9, 1989

[54] ROTOR ASSEMBLY FOR POWER TONG

[75] Inventors: Charles W. Haynes; Adrian E. Pitts, both of Marshall, Tex.

[73] Assignee: Cooper Industries, Inc., Houston, Tex.

[21] Appl. No.: 912,442

[22] Filed: Sep. 26, 1986

[51] Int. Cl.[4] ..... B25B 17/00

[52] U.S. Cl. ..... 81/57.18

[58] Field of Search ..... 81/57.14, 57.15, 57.16, 81/57.18, 57.3, 57.33, 57.34

[56] References Cited

U.S. PATENT DOCUMENTS

| | | | |
|---|---|---|---|
| 3,540,326 | 11/1970 | Dickman et al. | 81/57.18 |
| 3,875,826 | 4/1975 | Dreyfuss et al. | 81/57.18 |
| 4,215,602 | 8/1980 | Carstensen et al. | 81/57.18 |
| 4,250,773 | 2/1981 | Haynes et al. | 81/57.18 |
| 4,437,363 | 3/1984 | Haynes | 81/57.18 |

*Primary Examiner*—Frederick R. Schmidt
*Assistant Examiner*—Judy J. Hartman
*Attorney, Agent, or Firm*—Eddie Scott; David Alan Rose; William E. Shull

[57] ABSTRACT

A rotary power tong for use in well drilling operations to make up and break out drill strings or similar axially elongated objects having a housing receiving a rotor assembly therein for actuating jaw members into the drill string for rotation of the drill string. The rotor assembly has a generally annular rotor with a plurality of axial bores therethrough positioned in a generally circular pattern adjacent the outer periphery of the rotor. Each axial bore receives a roller assembly comprising a shaft received through the axial bore and secured to the rotor and a roller bearing secured to the bottom of the shaft extending below the rotor. The roller bearing rotates relative to the shaft and rotor. The rotor assembly is received within a circular guide track within the housing such that the rotor assembly load is balanced evenly within the housing providing for a smooth rotational operation of the power tong. The unique rotor design allows the roller assemblies to be repaired or replaced without removing the rotor from the housing assembly.

6 Claims, 3 Drawing Sheets

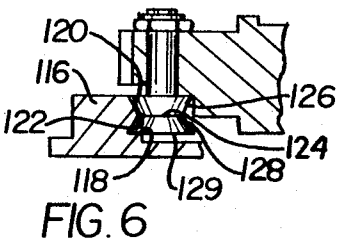
FIG. 6
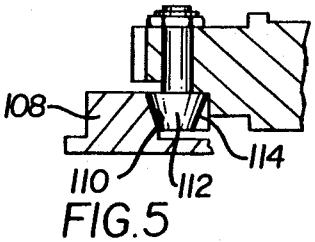
FIG. 5
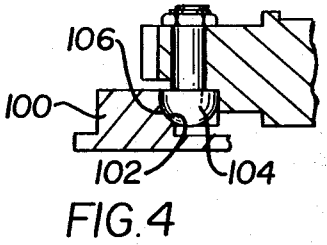
FIG. 4
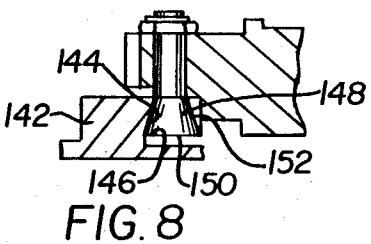
FIG. 8
FIG. 7
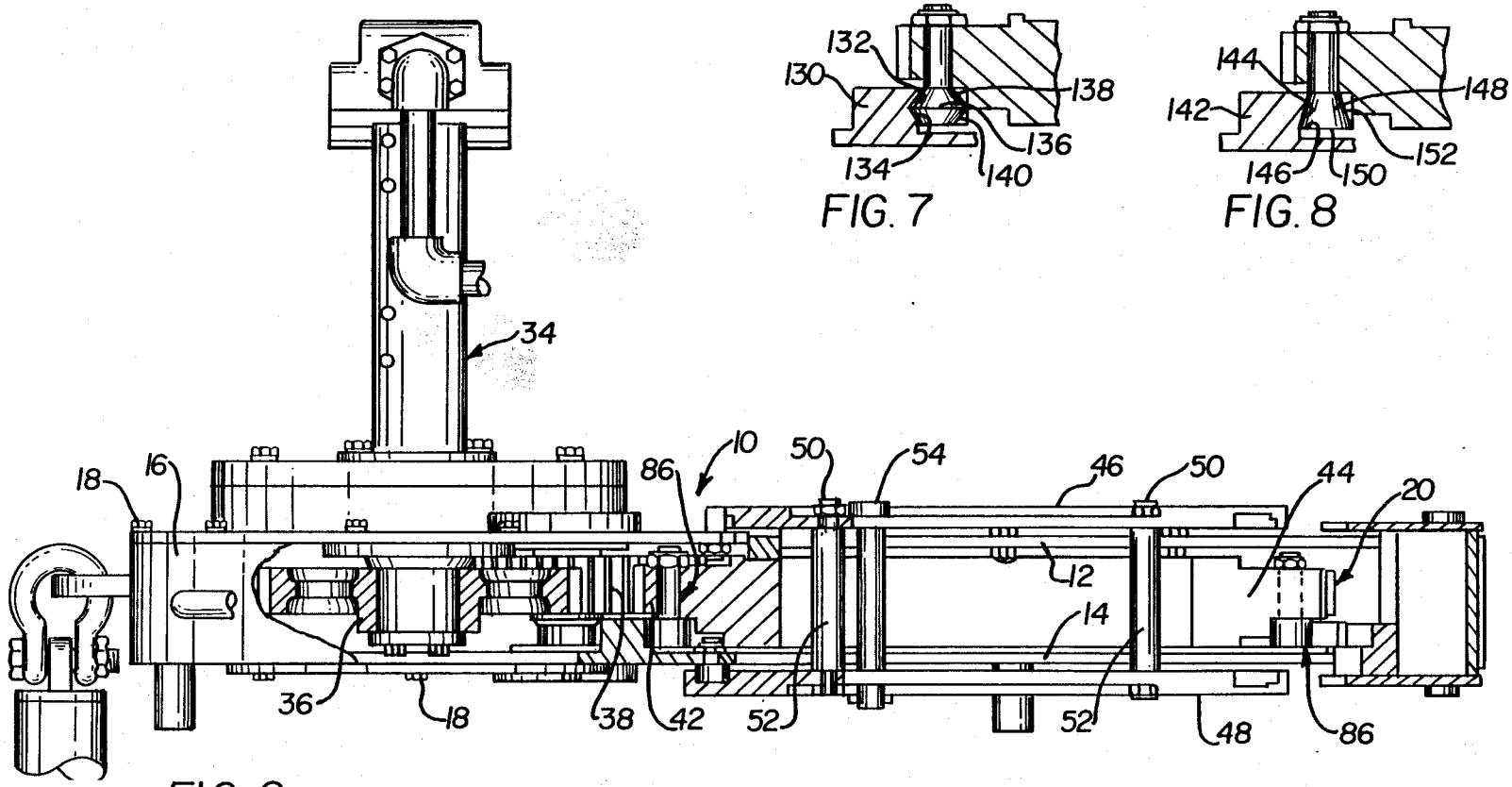
FIG. 2

ROTOR ASSEMBLY FOR POWER TONG

BACKGROUND OF THE INVENTION

1. Field of the Invention

The present invention relates to power tongs, and more particularly, is directed to a power tong utilizing a rotor assembly providing improved maintenance and operating capabilities and a power tong that is easier to manufacture.

2. Description of the Prior Art

In well-drilling operations, a rotary power tong is used to grip and rotate lengths of pipe or rods which are connected together by threaded end sections. In the usual case, the power tong is of the open-headed type, having a bifurcated housing and cover with a center opening and an outwardly-open passageway or throat which permits the tong to be positioned around a pipe joint without the necessity of lowering the tong over a length of the pipe.

When the tong is operated, pipe-gripping means (often referred to as jaws) are caused to revolve around the aforesaid central opening, these jaws causing the pipe or casing section to rotate. Most tongs accomplish the gripping action of the jaws by means of a rotating rotor assembly which forces a cam attached to the jaw frame to lock into position against a cam surface along the inside surface of the rotor upon initial rotation of the rotor assembly. The action of the cam against the cam surface forces the jaws radially inward causing the jaws to engage the pipe. Continued rotation of the rotor assembly imparts rotation to the jaws and pipe as required.

Typically, the rotors of the prior art devices are rotated on roller assemblies secured within the power tong housing and cover. These roller assemblies were positioned in a generally circular pattern around the generally annular rotor to guide and support the rotor for rotation within the housing. Since the roller assemblies were secured within both the housing and cover, close manufacturing tolerances were required when machining the holes in the housing and cover for securing the roller assemblies in place. If the roller assemblies are not positioned co-axially above and below one another, the rotor can become unbalanced providing for uneven loading and rotation within the housing. An unbalanced rotor can cause premature wear and tear on the respective moving parts of the power tong assembly.

Furthermore, to inspect and lubricate the roller assemblies it is required to remove the housing cover and rotor from the tong which requires lengthy down time and manual labor, resulting in high maintenance costs.

Accordingly, it is an object of the present invention to provide a power tong incorporating a rotor assembly and roller assemblies which provide for a smooth, balanced rotor rotation within the housing to limit the premature wear and tear of the moving parts of the power tong.

Another object of this invention is to provide a power tong wherein the roller assemblies can be lubricated, repaired and/or replaced without removing the housing cover or rotor from the power tong assembly.

Yet another object of this invention is to provide a power tong which is easier to manufacture and at a lower cost than prior art power tong devices.

These, together with other objects and advantages of the invention, will become more apparent upon reading the following specification.

SUMMARY OF THE INVENTION

In accordance with the present invention, a power tong assembly is provided utilizing a rotor assembly having a generally annular rotor with a central axis and an open throat or slotted portion extending from a central rotor opening radially to the outer periphery of the rotor. The rotor has a plurality of gear teeth on its outer periphery and diametrically-opposed depression or cam surfaces on its inner periphery. A plurality of axial bores are positioned about and extend through the rotor in a generally circular pattern adjacent to the outer rotor periphery. A roller assembly is positioned in each of the axial bores. The roller assemblies include a shaft which extends through the axial bores of the rotor and a roller bearing secured to the bottom end of the shaft such that the roller bearing is allowed to rotate relative to the shaft. The roller assembly is secured to the rotor with a nut which is threaded onto a cooperatively threaded upper end of the shaft extending above the rotor.

In the preferred embodiment of the invention, the rotor assembly is carried within a power tong housing. The housing consists of upper and lower plates separated by a side wall and includes drive means carried by the housing for rotating the rotor within the housing. The housing has a central opening which communicates with a slotted portion or throat to permit the tong assembly to be inserted around a tube or pipe section which is to be rotated. The housing includes a generally circular guide track extending up from the lower housing plate surrounding the central opening in the lower housing plate and throat for receiving the roller bearings of the rotor assembly rollers. A door assembly is pivotally connected to the housing at the end of the slotted housing portions to totally close in the central opening. The door assembly includes a arcuate guide track portion which is adapted to line up with the generally circular housing guide track to form a complete circular guide path for the rotor within the housing.

A pair of jaw elements with cam followers interact with the diametrically opposed cam surfaces on the inner rotor periphery to grip a pipe or casing section to be rotated upon rotation of the rotor assembly.

The slotted portion or throat of the rotor can be aligned with the slotted portions of the housing plates to allow the power tong to be inserted around a pipe or casing which is to be rotated. Thereafter, the door assembly is closed and the motor is actuated to rotate the rotor assembly about its roller assemblies within the housing and door guide tracks.

In order to provide lubrication, repair or replacement of assemblies, it is only necessary to rotate the rotor such that a roller assembly is positioned within the open throat portion of the housing plates. Then, any repairs may be made without removing either the upper housing plate cover or the rotor assembly from the tong assembly.

BRIEF DESCRIPTION OF THE DRAWINGS

The above and other objects and features of the invention will become apparent in the following detailed description of several preferred embodiments of the invention taken in conjunction with the accompanying drawings which are a part of the specification and in which:

FIG. 2 is a vertical cross-sectional view of the tong assembly in FIG. 1 taken substantially along line 2—2 of FIG. 1, wherein the jaw assembly has been removed from the central housing opening to ease viewing of the rotor assembly;

FIGS. 4–8 are cross-sectional views of alternative embodiments of the rotor roller assembly of the present invention.

DESCRIPTION OF THE PREFERRED EMBODIMENT

Figure 1:
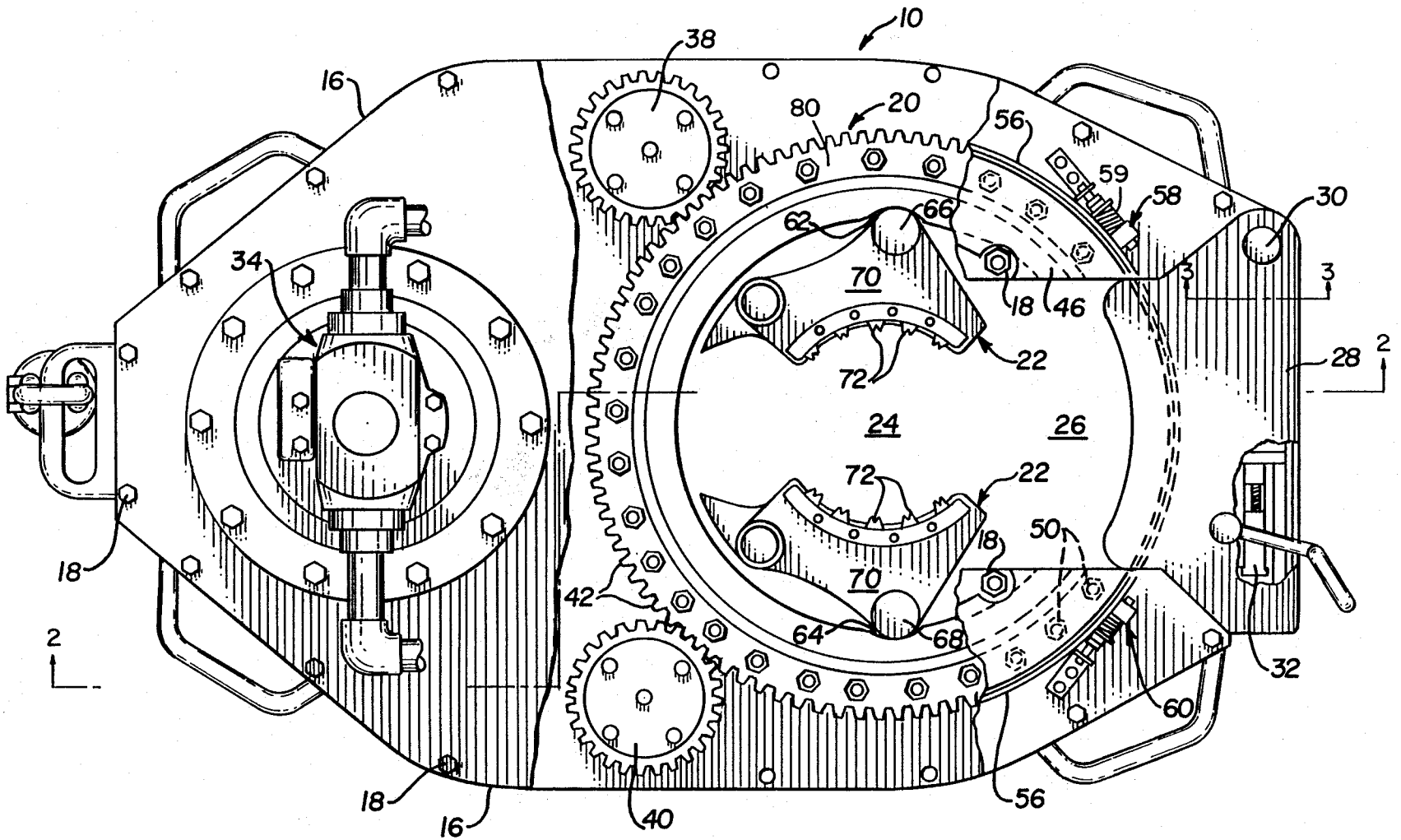
FIG. 1 is a top view of the tong assembly incorporating a preferred embodiment of the rotor assembly of the present invention, a portion of the cover plate and upper drag plate have been cut away to show the rotor in position within the tong assembly.

In the following description, it is to be understood that such terms as "left", "right", "upper", "lower", "inner" and "outer" are words of convenience and are not to be construed in a limiting sense. The terms "left", "right", "upper" and "lower" refer to the position of a component in reference to the position of the power tong assembly in the drawings and the terms "inner" and "outer" refer to the position of a component in reference to the central axis of the central housing and rotor openings.

With reference now to the drawings, and particularly to FIGS. 1 and 2, the tong assembly shown includes a housing 10 comprising upper and lower plates 12 and 14 spaced apart by sidewall 16 and held together by means of bolts 18. The left or back end of the housing 10, as shown in FIGS. 1 and 2, encloses gearing to be described; while the right or forward end carries a generally annular rotor assembly 20 which will be described in greater detail below.

As is best shown in FIG. 1, the upper and lower plates 12 and 14 are provided with coaxial semi-circular openings 24 which communicate with a throat 26 to permit the tong assembly to be inserted over a tube or pipe section which is to be rotated. A door assembly 28 is pivotally connected at one end a shown at 30 to one side of the housing and is provided at its other end with a releasable latch 32 which is received on the other side of the housing to close the throat 26. In the use of the tong assembly, the latch 32 is disengaged; the door assembly 28 is pivoted outwardly; and the tong is then pushed into a position where the pipe or tubing to be rotated is within the semi-circular portion 24, whereupon the gate assembly is again closed and latched closing the pipe within the housing openings 24.

As seen in FIGS. 1 & 2, a pneumatic or hydraulic motor 34 is carried on the top of the housing 10 which through gear 36 (FIG. 2) rotates two pinion gears 38 and 40 (FIG. 1). The gears 38 and 40, in turn, mesh with gear teeth 42 on the outer periphery of the rotor assembly 20 such that as the gears 38 and 40 rotate, so also will the rotor assembly 20. The spacing between gears 38 and 40 insures that the rotor assembly will continue to rotate whenever an opening or throat 44 of the rotor assembly is positioned adjacent one of the pinion gears 38 and 40.

Adjacent the upper and lower surfaces, respectively, of the housing plates 12 and 14 are upper and lower annular drag plates 46 and 48, respectively. The drag plates 46 and 48 are interconnected by bolts 50 which serve to hold a jaw assembly 22 into place within the semi-circular portion 24 of the housing. Surrounding the periphery of the upper drag plate 46 is a drag band 56 which is connected to the stationary top plate by means of adjusting screws 58 and 60 which pass through the bolt holes on the ends of the drag band 56. The drag band 56 can be tightened against the periphery of the plate by means of the adjusting screws 58 and 60 which when tightened close the inside diameter of the drag band 56 around the plate 46. The adjusting screws 58 and 60 are tightened against compression springs 59 which force the drag band 56 tight around the plate 46.

As best shown in FIG. 1, the inner periphery of the rotor assembly 20 is provided with diametrically-opposed depressions or cam surfaces 62 and 64 which receive cam follows 66 and 68 carried on the jaw assembly 22. Jaw assembly 22 also includes pivoted jaw elements 70 which are pivotally mounted to the upper and lower drag plates 46 and 48 by bolts 54. Jaw inserts 72 are inserted within the inner periphery of jaw elements 70 to grip a pipe or casing upon inward actuation of the jaw assembly.

Figure 3:
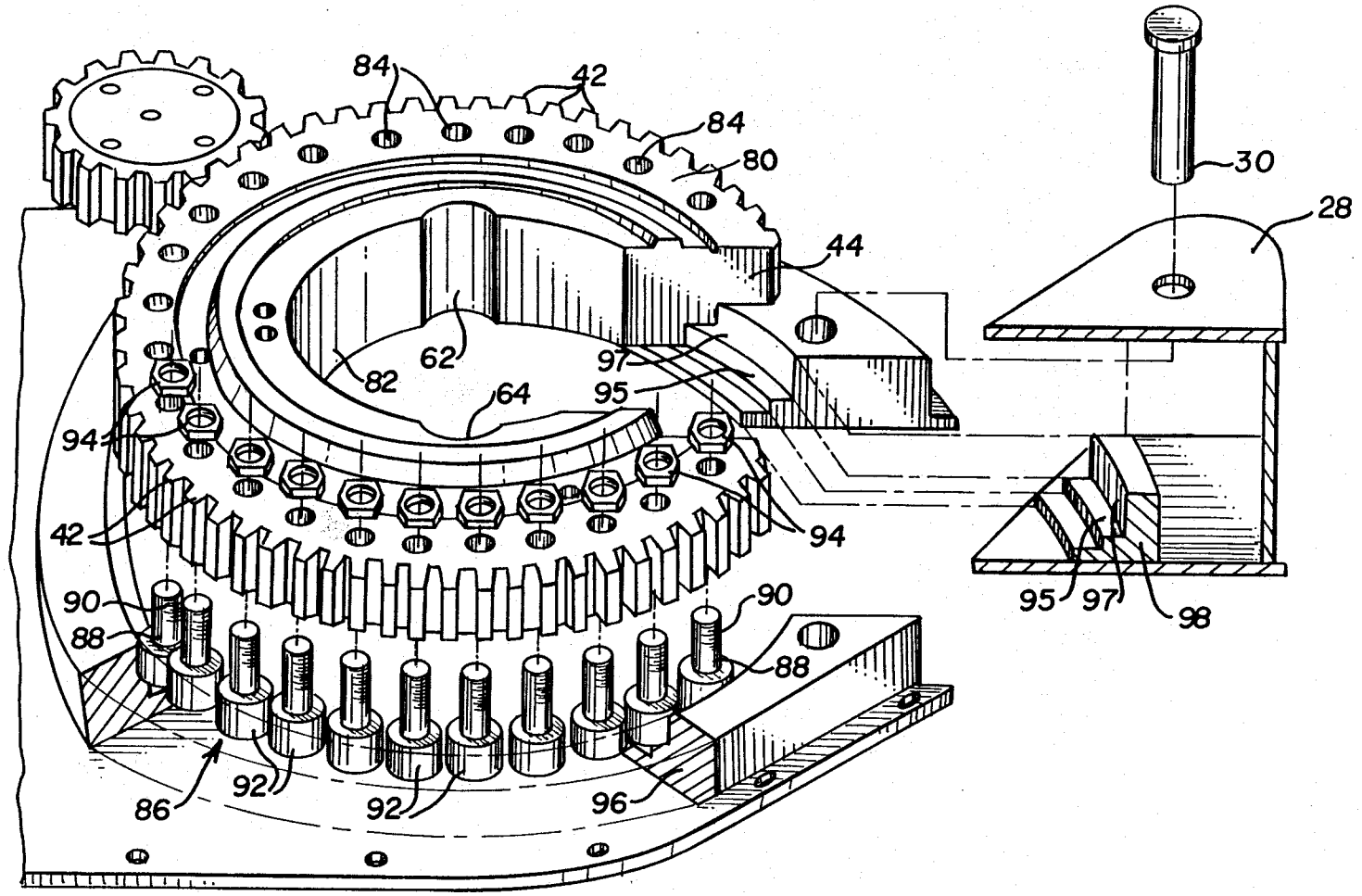
FIG. 3 is an exploded isometric view of the rotor assembly shown fitting within a cut-away portion of the tong housing, wherein the door assembly is shown in a cross-sectional view taken along line 3—3 of FIG. 1 to show the inside guide track thereof.

The rotor assembly 20 of the present invention is best seen in FIG. 3. FIG. 3 shows only a portion of the lower housing plate 14 without the upper housing plate 12, upper and lower drag plates 46 and 48 or jaw assembly 22 so that the details of the present invention may be more clearly seen. The rotor assembly 20 includes a generally annular rotor 80 having gear teeth 42 along its outer periphery and a central opening 82 which communicates with the throat 44. Rotor 80 is positioned within the housing so that the axis of opening 82 is coaxially aligned with the openings 24 in housing plates 12 and 14. The rotor 80 has a plurality of axial bores 84 extending through the axial height of the rotor and are positioned about the rotor in a generally circular pattern adjacent the outer periphery of the rotor. Each of the axial bores 84 receives a roller assembly 86. The roller assemblies 86 each include a shaft 88 externally threaded at one end as shown at 90, a roller bearing 92 secured to the bottom end of shaft 88 being capable of freely rotating about the shaft 88, and a nut 94. The shaft 88 of the roller assembly 86 is inserted through the axial bore 84 of the rotor such that the roller bearing 92 is positioned adjacent the bottom of rotor 80. The nut 94 is received about the threaded portion 90 of shaft 88 extending above the top of rotor 80 to secure each of the roller assemblies to the rotor 80.

The lower housing plate 14 includes an upwardly extending generally annular guide track 95. The guide track 95 can be machined directly from the housing plate 14 or it can be machined separately and welded to plate 14 to provide a generally circular guide path for the roller assemblies 86 of rotor 80. FIG. 3 also shows the door assembly 28 in cross-section such that a door guide track 98 is shown. When the door assembly 28 is in the closed position, guide tracks 96 and 98 form a substantially circular guide path for the rotor roller assemblies 86 within housing 10.

The guide tracks 96 and 98 provide an "L-shaped" bearing surface having a bottom support surface 95 and an annular side surface 97 for supporting the roller assemblies 86 of rotor 80 as shown in FIG. 3. The roller bearing 92 of roller assembly 86 is shown as a free wheeling circular bearing which represents the preferred configuration for providing a smooth rolling rotor assembly. However, other guide track and roller bearing configurations exist that could all provide adequate rotational characteristics for rotor assembly 20.

FIG. 4 shows a modified guide track 100 having a rounded concave support surface 102. The roller assembly bearing 104 is provided with a convex surface 106 riding within the concave surface 102 of guide track 100.

FIG. 5 shows a modified guide track 108 having an upwardly facing frusto-conical support surface 110. The roller assembly bearing 112 is provided with a downwardly facing frusto-conical surface 114 riding within the guide track support surface 110.

FIG. 6 shows a guide track 116 having a flat cylindrical support surface 118 and two inwardly converging frusto-conical side surfaces 120 and 122. The roller assembly bearing has two outwardly diverging frusto-conical surfaces 126 and 128 and a bottom cylindrical support surface 129 riding within the guide track 116.

FIG. 7 shows a guide track 130 having two inwardly diverging frusto-conical support surfaces 132 and 134. The roller assembly bearing 136 is provided with two outwardly converging frusto-conical surfaces 138 and 140 riding within guide track 130.

And, FIG. 8 shows a guide track 142 having a downwardly facing frusto-conical side surface 144 and a bottom flat cylindrical support surface 146. The roller assembly bearing 148 is provided with a bottom surface 150 and an upwardly facing frusto-conical surface 152 riding within guide track 142.

In the operation of the assembly shown in FIGS. 1–3, the door assembly 28 is opened and the tong assembly is inserted over a casing which is to be rotated (not shown) so as to thread it into an aligned casing section, for example. Thereafter, the door assembly 28 is closed and motor 34 is actuated to rotate the rotor assembly 20 between the housing plates 12 and 14. As the rotor assembly 20 rotates, causing rotor 80 to spin upon roller assemblies 86 within housing and door guide tracks 96 and 98, the upper and lower drag plates 46 and 48 initially will be held stationary by drag band 56. During this time, the cam followers 66 and 68 ride up the cam surfaces 62 and 64 formed on the inner periphery of the rotor 80, thereby forcing the jaw elements 70 to rotate inwardly about the axes of bolts 54 until jaw inserts 72 engage the outer periphery of the casing section. At this point, due to the frictional engagement between the casing section and the jaw inserts, the upper and lower drag plates 46 and 48 being connected with two jaw bolts 50 (see FIG. 2) and unitized with two jaw elements 70 will overcome the restraining force of the drag band 56 which is affixed to the stationary top cover and spring tensioned tight around the upper drag plate 46 and will rotate with the rotor 80 thereby carrying the drag plates 46 and 48 and the jaw elements 70 mounted thereon with it. In this fashion, the casing section is caused to rotate.

In accordance with the present invention, the roller assemblies 86 may be easily repaired or replaced without dismantling the housing. It is only necessary to rotate the rotor assembly to position the particular roller assembly to be repaired or replaced within the throat 26 of the housing where the roller assembly 86 may be easily reached. The roller assembly 86 may be easily removed for repair or replacement by removing the top nut 94 and removing the shaft 88 and roller bearing 92 through bottom side of housing throat 26. It is unnecessary to remove either the upper housing plate 12 or the rotor assembly 20 as was required with prior art power tongs.

Furthermore, since the roller assembly mounting bores 84 are initially machined in only piece, the rotor 80, and the roller assemblies 86 can be mounted on rotor 80 before being placed within housing 10, the power tong is easier to manufacture than the prior art tongs. The upper and lower housing plates 12 and 14 do not need to be identically machined with the exacting requirements as necessary in the prior art power tongs to provide a well-balanced, smooth rotor rotation within the housing.

Although the invention has been shown in connection with specific embodiments, it will be readily apparent to those skilled in the art that various changes in form and arrangement of parts may be made to suit requirements without separating from the spirit and scope of the invention.

We claim:

1. A power tong for axially rotating an axially elongated body which comprises:

a housing top and bottom plates, the plates having slotted portions for receiving the axially elongated body;

a generally annular rotor carried by said housing between said plates and rotatable relative to said housing about an axis extending generally perpendicular to the opposite sides of said housing and having a throat which is adapted to be aligned with the slotted portions of said housing so that the axially elongated body may be positioned within said rotor, said rotor further having a plurality of axial bores extending through the axial height of said rotor and positioned about the rotor in a generally circular pattern adjacent the outer periphery of the rotor;

a cam surface formed on the inner periphery of said rotor;

drive means carried by said housing for rotating said rotor;

a plurality of roller assemblies mounted on said rotor for supporting said rotor within said housing for rotational movement with respect to said housing, the roller assemblies each having a roller bearing rotatably mounted about a shaft disposed in one of said axial bores and providing relative rotational movement between the roller bearing and rotor;

a generally circular guide track coaxially positioned on one of the housing plates surrounding the central axis of said rotor, the guide track forming a partial circle about the rotor intercepted by the slotted portion in the housing plates, the guide track supporting the roller bearings of said roller assemblies to provide a smooth guide path for continuous rotor rotation within said housing; and jaw gripping means carried by said housing for selectively gripping and rotating the axially elongated body upon rotation of said rotor, said jaw gripping means having gripping teeth and a cam follower which interacts with the cam surface of said rotor to direct the gripping teeth into contact with the axially elongated body to be rotated.

2. A power tong as recited in claim 1 which further comprises:

a door assembly pivotally mounted to the top and bottom plates of said housing and being adapted to close the slotted portion of said housing, said door assembly having an arcuate guide track therein adapted to line up with the housing guide track to form a substantially continuous circular guide path for rotation of said rotor within said housing and door assembly.

3. A power tong for axially rotating an axially elongated body which comprises:

a housing having a bottom plate with a semi-circular opening therein having a transverse axis and a slotted portion extending radially from the opening to the outer periphery of said housing for receiving the axially elongated body;

a generally annular rotor carried by said housing and rotatable relative to said housing about a central axis and having a central opening with a throat radially extending from the central opening to the outer periphery of said rotor, the throat being adapted to be aligned with the slotted portion of the housing plate for receiving the axially elongated body within the central opening of said rotor;

a cam surface formed on the inner periphery of the central rotor opening;

drive means carried by said housing for rotating said rotor;

roller means removably mounted on said rotor for supporting said rotor within said housing for rotational movement with respect to said housing, said roller means comprising a plurality of roller bearing assemblies circumferentially spaced apart about the outer periphery of said rotor, each of said roller bearing assemblies including a roller bearing mounted on a shaft secured in one of a plurality of axial bores in said rotor, each roller bearing being mounted for rotational movement about its shaft and with respect to said rotor, each of said roller bearing assemblies being completely removable from said rotor when said rotor is indexed so that the roller bearing assembly to be removed is aligned with the slotted portion of the housing plate;

a generally circular guide track positioned on the housing plate surrounding the central axis of said rotor providing a generally circular guide path for receiving and coaxially supporting the roller bearings of said roller assemblies of said rotor within said guide track; and jaw gripping means carried by said housing for selectively gripping and rotating the axially elongated body upon rotation of said rotor.

4. A power tong as recited in claim 3 which further comprises:

a door assembly pivotally mounted to the bottom plate of said housing and being adapted to close the slotted plate portion, said door assembly having an arcuate guide track therein adapted to line up with the housing guide track when the door assembly is in its closed position to form a substantially continuous circular guide path for rotation of said rotor within said housing and door assembly.

5. A power tong as recited in claim 4 wherein said roller bearing assemblies are positioned in a generally circular pattern about the rotor; each of said shafts being received through its axial bore in the rotor and secured thereto such that the attached roller bearing is positioned adjacent to the bottom of the rotor.

6. An improved rotor assembly for providing radial and rotational movement to a set of jaw elements in a power tong to rotate an axially elongated body of the type having a housing with a bottom plate having an opening therein and a slotted portion extending radially from the opening to the outer periphery of the housing for receiving the axially elongated body, a generally annular rotor carried by said housing and rotatable relative to said housing about an axis extending generally perpendicularly to the bottom housing plate and having a throat which can be aligned with the slotted portion of said housing, a cam surface formed on the inner periphery of said rotor, drive means carried by said housing for rotating said rotor, jaw gripping means carried by said housing for selectively gripping the axially elongated body and rotatable therewith upon rotation of said rotor, a door assembly pivotally connected to one side of the slotted housing portion and adapted to latch to the other side of the slotted housing portion to enclose the axially elongated body within the housing and door assembly, wherein the improvement comprises:

a plurality of roller assemblies mounted on the rotor for supporting the rotor within the housing for rotational movement with respect to the housing, the roller assemblies each having a roller bearing rotatably mounted on a shaft secured in one of a plurality of axial bores through the axial height of said rotor and circumferentially spaced about the outer periphery of said rotor, each of said roller assemblies providing relative rotational movement between the roller bearing and rotor;

a generally circular guide track positioned on the bottom housing plate surrounding the central axis of the rotor, the guide track forming a partial circle about the rotor intercepted by the slotted portion of the housing plate, the housing guide track supporting the roller bearings of said roller assemblies; and the door assembly having an arcuate guide track therein adapted to line up with the housing guide track when the door assembly is in its closed position to form a substantially continuous circular guide path for supporting the roller assemblies of the rotor to provide for smooth rotation of the rotor within the housing and door assembly.

* * * * *